US010253594B2

(12) United States Patent
Wakefield et al.

(10) Patent No.: US 10,253,594 B2
(45) Date of Patent: Apr. 9, 2019

(54) INTERVENTIONLESS PRESSURE OPERATED SLIDING SLEEVE

(71) Applicant: BAKER HUGHES, A GE COMPANY, LLC, Houston, TX (US)

(72) Inventors: John K. Wakefield, Cypress, TX (US); Robert S. O'Brien, Katy, TX (US); Alexander Kendall, Houston, TX (US); Stephen A. Graham, Houston, TX (US); Peter J. Clark, Houston, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 35 days.

(21) Appl. No.: 15/373,963

(22) Filed: Dec. 9, 2016

(65) Prior Publication Data

US 2018/0163507 A1 Jun. 14, 2018

(51) Int. Cl.

| | |
|---|---|
| ***E21B 34/10*** | (2006.01) |
| ***E21B 43/26*** | (2006.01) |
| ***E21B 43/25*** | (2006.01) |
| ***E21B 34/06*** | (2006.01) |
| *E21B 34/00* | (2006.01) |

(52) U.S. Cl.

CPC ..... *E21B 34/10* (2013.01); *E21B 34/063* (2013.01); *E21B 34/102* (2013.01); *E21B 43/25* (2013.01); *E21B 43/26* (2013.01); *E21B 2034/007* (2013.01)

(58) Field of Classification Search

CPC ..... E21B 34/10; E21B 34/063; E21B 34/102; E21B 43/25; E21B 43/26; E21B 2034/00

See application file for complete search history.

(56) References Cited

U.S. PATENT DOCUMENTS

| | | | | | |
|---|---|---|---|---|---|
| 3,821,962 | A * | 7/1974 | Mott | E21B 34/08 | 137/12 |
| 3,879,012 | A * | 4/1975 | Mott | E21B 34/08 | 251/58 |
| 4,134,454 | A * | 1/1979 | Taylor | E21B 34/10 | 137/629 |
| 4,361,188 | A * | 11/1982 | Russell | E21B 34/102 | 166/319 |
| 4,473,122 | A | 9/1984 | Tamplen | | |
| 4,508,174 | A * | 4/1985 | Skinner | E21B 23/006 | 166/178 |

(Continued)

FOREIGN PATENT DOCUMENTS

| | | |
|---|---|---|
| WO | 9730269 | 8/1997 |

*Primary Examiner* — Matthew R Buck
*Assistant Examiner* — Aaron L Lembo
(74) *Attorney, Agent, or Firm* — Shawn Hunter

(57) ABSTRACT

A zone to be treated comprises a plurality of sliding sleeve valves. The sleeve defined opposed chambers charged with pressurized fluid on opposed sides of the sleeve. Valves responsive to a remote signal with no borehole intervention change the pressure balance on the sleeve to get it to open from a closed position and then close and then to reopen for production. One way this is done is by sequential pressure bleeding off from the opposed chambers. A zone having multiple such valves can be treated without need for dropping balls and subsequent milling out, which allows production to commence sooner with reduced restrictions to flow from the ball seats and without the debris associated from a milling operation.

24 Claims, 3 Drawing Sheets

(56) References Cited

U.S. PATENT DOCUMENTS

| | | | | |
|---|---|---|---|---|
| 6,502,640 | B2 * | 1/2003 | Rayssiguier | E21B 23/006 166/321 |
| 6,505,684 | B2 * | 1/2003 | Rayssiguier | E21B 23/006 166/237 |
| 6,668,936 | B2 * | 12/2003 | Williamson, Jr. | E21B 23/04 166/240 |
| 6,854,519 | B2 * | 2/2005 | Deaton | E21B 34/10 166/332.8 |
| 6,892,816 | B2 * | 5/2005 | Pringle | E21B 23/006 166/313 |
| 7,926,575 | B2 * | 4/2011 | Ringgenberg | E21B 23/006 166/324 |
| 8,387,706 | B2 * | 3/2013 | Baugh | E21B 33/038 166/339 |
| 8,915,300 | B2 * | 12/2014 | Sommers | E21B 34/102 166/334.4 |
| 9,359,864 | B2 * | 6/2016 | Harris | E21B 34/101 |
| 9,359,865 | B2 * | 6/2016 | Mailand | E21B 23/006 |
| 9,476,282 | B2 * | 10/2016 | Anton | E21B 34/063 |
| 9,500,063 | B2 * | 11/2016 | Greenan | E21B 34/102 |
| 2011/0174491 | A1 * | 7/2011 | Ravensbergen | A61K 48/0025 166/308.1 |
| 2013/0056220 | A1 * | 3/2013 | Sommers | E21B 34/102 166/373 |
| 2017/0089157 | A1 * | 3/2017 | Noske | E21B 34/06 |

* cited by examiner

INTERVENTIONLESS PRESSURE OPERATED SLIDING SLEEVE

FIELD OF THE INVENTION

The field of the invention is borehole tools operated between multiple positions with interventionless signaling to pressurized fluid sources associated with the borehole tool or a surrounding annulus in the borehole.

BACKGROUND OF THE INVENTION

Sliding sleeves in tubular strings have been moved in the past with direct application of hydraulic pressure applied to a sealed chamber where the sleeve acts as a piston. Rising pressure puts a force on the sleeve to change its position. This is a sleeve actuation method frequently used in subsurface safety valves such as in U.S. Pat. No. 4,473,122. Other ways of moving a sleeve are to use ball screws or similar mechanical devices to force a sleeve to translate or to rotate as shown in WO97/30269.

Sleeve valves are frequently used in fracturing where ports are covered by a sleeve when running in and subsequently opened for treatment. After treatment the ports are closed with sleeve movement and then need to be reopened when the entire zone is treated for production from the formation. One way this is done now is to shift a sleeve with pressure on a ball landed on a seat supported by the sliding sleeve so that the ports are opened for treatment. After the treatment through an opened valve is concluded another ball that is larger lands on the next sleeve uphole and in effect isolates the ports opened by the previous sleeve so that treatment at the next set of ports in an uphole direction can take place. This process is repeated with progressively larger balls until the entire interval is treated. After that, all the balls are drilled out and if needed certain sleeves are closed with a shifting tool before production begins through the open sleeves. There are drawbacks to this well-known method of fracturing or otherwise treating a formation. There can be a large number of balls that have to be delivered in size order that are only minimally different in diameter. This can cause operator confusion. The sleeves have seats that restrict the produced fluid flow to some degree. The milling is time consuming and creates debris in the borehole that can adversely affect the operation of other tools with small clearances.

The method and apparatus of the present invention provides an interventionless way to open, then close and then reopen specific sliding sleeves so that a particular sleeve can provide access for treatment and then get closed as another sleeve is actuated to continue the treatment. Thereafter a selected sleeve can be reopened and locked open for production. Ball seats and milling are eliminated allowing for production to begin that much faster. The movement of the sleeve is accomplished with signal responsive valves that vary resistance to movement in pressurized chambers on opposed sides of a sliding sleeve valve. Tubing or annulus pressure can be employed to reopen a port after the sleeve has been otherwise opened and closed for the earlier treatment. These and other aspects of the present invention will be more readily apparent from a review of the description of the preferred embodiment and the associated drawings while recognizing that the full scope of the invention is to be determined by the appended claims.

SUMMARY OF THE INVENTION

A zone to be treated comprises a plurality of sliding sleeve valves. The sleeve defined opposed chambers charged with pressurized fluid on opposed sides of the sleeve. Valves responsive to a remote signal with no borehole intervention change the pressure balance on the sleeve to get it to open from a closed position and then close and then to reopen for production. One way this is done is by sequential pressure bleeding off from the opposed chambers. A zone having multiple such valves can be treated without need for dropping balls and subsequent milling out, which allows production to commence sooner with reduced restrictions to flow from the ball seats and without the debris associated from a milling operation.

DETAILED DESCRIPTION OF THE PREFERRED EMBODIMENT

Figure 1:
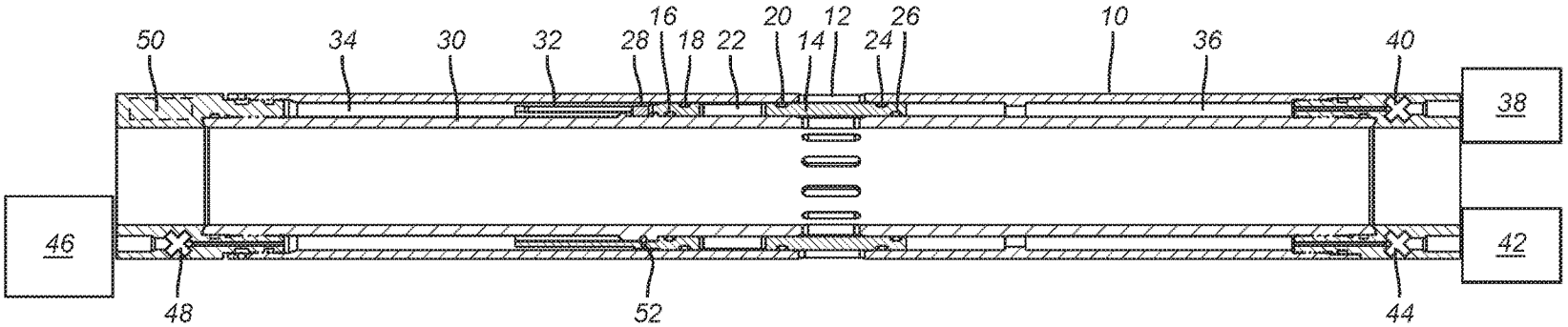
FIG. 1 is a section view of the three reservoir design in the run in position.

FIG. 1 shows a housing 10 having elongated ports 12 that are covered with sleeve 14 for running in. Seals 16 and 18 are uphole of ports 22 on sleeve 14 and seal 20 is downhole of ports 22 on sleeve 14. Seal 20 is located apart from seals 24 and 26 so that the openings 12 are sealed off using the segment of sleeve 14 between these seals when running in. Ports 22 are identical in shape but slightly smaller than ports 12 and their alignment is maintained by a rotational lock on sleeve 14. The aligned ports in mandrel 30 are also the same shape but slightly smaller than ports 22. The lock is accomplished by a lug 28 supported from mandrel 30 that extends into an axial slot that is not shown in the uphole end 32 of sleeve 14. Uphole end 32 can be selectively engaged to a ratchet lock as will be described with regard to FIG. 5 to hold a reopened position shown in FIG. 4.

Variable volume chambers 34 and 36 are located on opposed sides of the sliding sleeve 14. Although single chambers are shown there can be additional chambers on opposed sides of the sliding sleeve 14 to enable manipulation of that sleeve additional times. In one embodiment these two chambers can be charged with a compressible fluid so that there is no net force on the sleeve 14. In one example if the piston areas defined between seals 16 and 18 on one side and seals 24 and 26 on the other side of sleeve 14 are equal then the charge pressure in chambers 34 and 36 will be equal. Reservoir 38 selectively communicates with chamber 36 through interventionlessly actuated valve 40. Reservoir 42 selectively communicates with reservoir 36 through interventionlessly actuated valve 44. Reservoir 46 selectively communicates with chamber 34 through interventionlessly operated valve 48. A power supply and signal processor is schematically illustrated as 50. Signals of various types can be received by processor 50 to selectively actuate valves 40, 44 and 48 in a desired order to get the required movements of sleeve 14. A shear pin or equivalent 52 can fixate sleeve 14 for running in.

Figure 2:
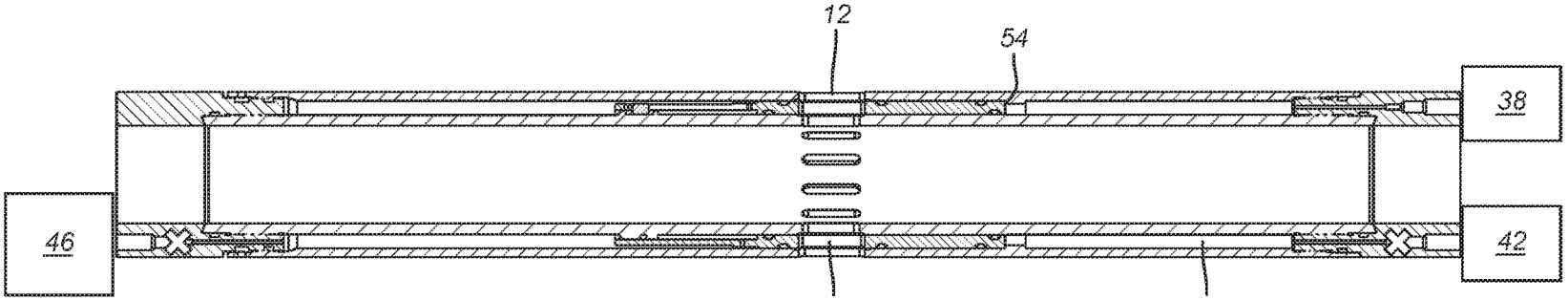
FIG. 2 is the view of FIG. 1 with the sleeve in the ports open position.
Figure 3:
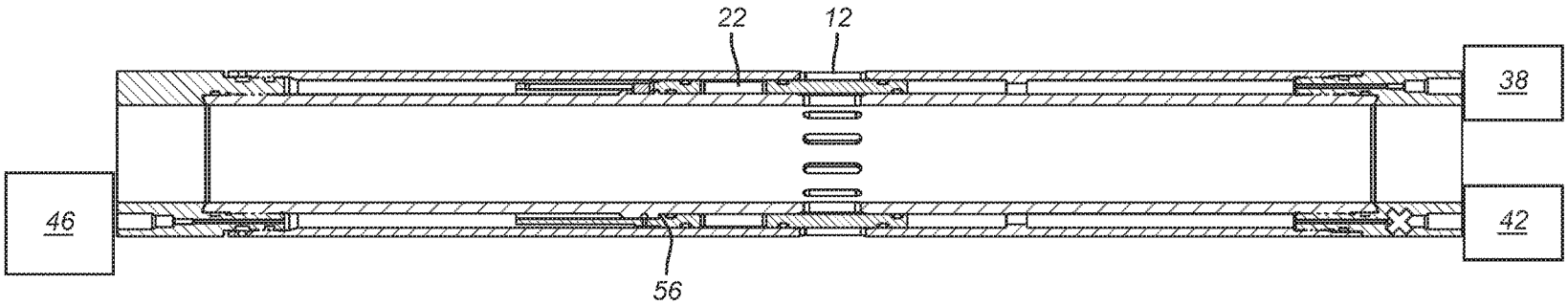
FIG. 3 is the view of FIG. 2 with the sleeve in the ports closed position.
Figure 4:
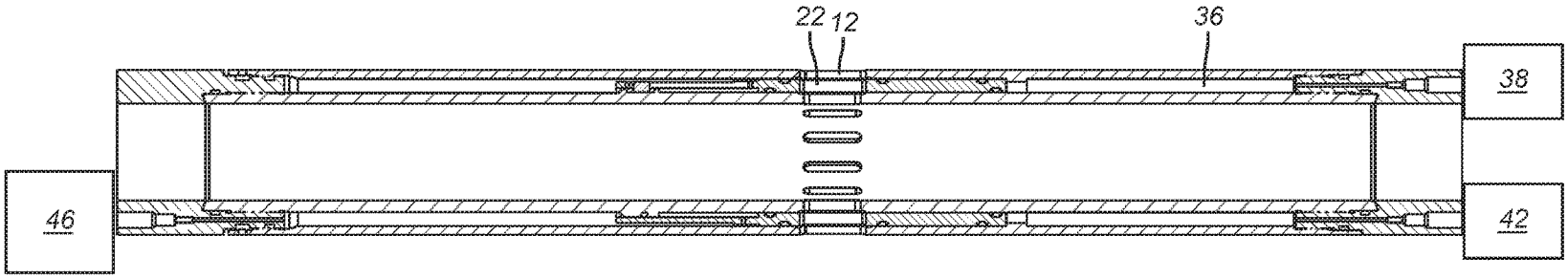
FIG. 4 is the view of FIG. 3 with the sleeve shifted to reopen the ports.

Reservoirs 38, 42 and 46 are at atmospheric pressure or another pressure lower than chambers 34 or 36. In FIG. 2 valve 40 is schematically illustrated as open to reduce the pressure in chamber 36. This creates a net force on sleeve 14 that breaks the shear pin 52 and moves sleeve 14 to put ports 22 into alignment with ports 12. To close by moving sleeve 14 in the opposite direction the valve 48 is opened as shown in FIG. 3. This reduces the pressure in chamber 34 to move sleeve 14 uphole to misalign ports 22 and 12 for the closed position. Note that travel stop 54 in FIG. 2 defines the open position for sleeve 14 while travel stop 56 defines the closed position. In the FIG. 3 closed position a ratchet ring is picked up by the sleeve 14 that is only shown in FIG. 5 but works the same way in FIGS. 1-4. This ring mates with another ratchet ring in a way that allows sleeve 14 to move downhole to a reopened position while preventing opposed movement toward closing. This locking action will be described in more detail regarding FIG. 5. In FIG. 4 valve 44 is opened to reduce pressure in chamber to once again align ports 22 with ports 12.

While operation with chambers 34 and 36 pressurized is described above the same movements of sleeve 14 can be achieved with chambers 34 and 36 at atmospheric or low pressure and reservoirs 38, 42 and 46 at high pressure with the positions of reservoirs 38 and 42 flipped with reservoir 46. To get the same movement sequence of sleeve 14 reservoirs 38 and 42 would need to be connected to chamber 34 and reservoir 46 would need to be connected to chamber 36. In essence the main difference would be that sleeve 14 is urged to move by increasing pressure in an adjacent chamber where the method described earlier reduces pressure in an adjacent chamber to sleeve 14 to create the force to move sleeve 14.

Figure 5:
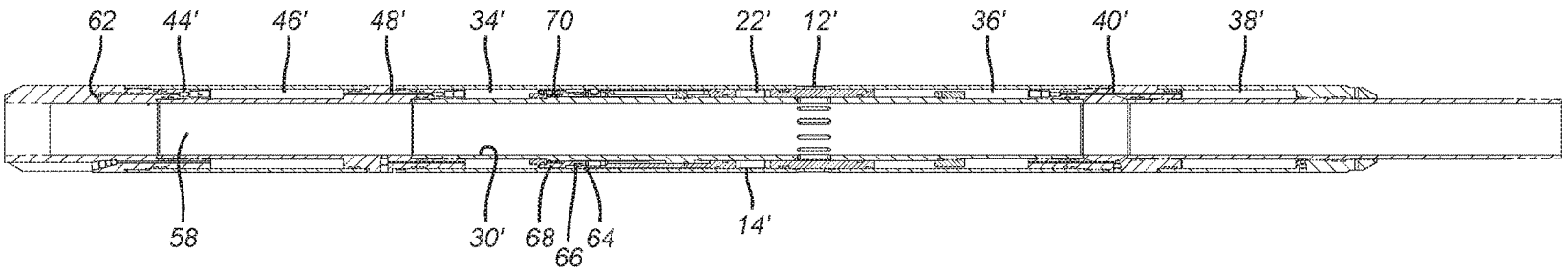
FIG. 5 is a section view when running in of a two reservoir variation of FIG. 1.

FIG. 5 differs from the FIG. 1 design in that two reservoirs 38' and 46' are used to respectively translate sleeve 14' to open and then closed positions as described before. Reservoir 38' is connected to chamber 36' by a schematically represented valve assembly 40', which when non-interventionally triggered to open will reduce pressure in chamber 36' to make sleeve 14' move to align ports 22' with ports 12'. Reservoir 46' is connected to chamber 32' although the passage connecting them is not shown in FIG. 5. Valve assembly 48' when non-interventionally triggered to open will reduce pressure in chamber 34' to let the sleeve 14' be urged to the closed position with ports 22' misaligned from ports 12'. Where FIG. 5 departs from FIG. 1's operating method is that there is no third reservoir as in FIG. 1. Instead pressure from tubing passage 58 goes into chamber 46' through opening 62. Chamber 46' has the power supply and processor for signals transmitted to operate valve assemblies 40', 46' and 44'. When assembly 44' is signaled to open, pressure from tubing passage 58 communicates to chamber 34' through open valve 48' to move sleeve 14' to align the ports 22' and 12' again for a reopening for production. In essence reservoir 42 from FIG. 1 is not used and is replaced by pressure available or added to the tubing at passage 58.

The locking mechanism that works identically in the FIGS. 1 and 5 designs involves an internal shoulder 64 near the top of sleeve 14' that passes over a snap ring 66 to engage lock sleeve 68 when sleeve 14' comes to the closed position where ports 22' are misaligned from ports 12'. Lock sleeve 68 carries with it ratchet ring 70 on subsequent movement of sleeve 14' to reopen. Ring 70 can ratchet over a mating profile (not shown) on an exterior surface of mandrel 30' as the reopened position is reached. However, reverse movement of sleeve 14' back to the closed position of misalignment of ports 22' with ports 12' is prevented. The lock in the FIG. 1 embodiment works the same way.

Those skilled in the art will appreciate that a number of such illustrated assemblies can be deployed in a given zone for treatment and then production. The valves can be operated in any desired order but bottom up or top down is preferred. Balls and ball seats are eliminated as well as subsequent need to mill out and the time and debris issues associated with milling out. There is no need to obstruct the tubing passage as the sliding sleeves are operated as with the ball and seat method of moving sleeves. Production can begin directly after the zone is treated with no milling delay. In the FIG. 5 embodiment the pressure to reopen can alternatively come from the annulus rather than tubing. The non-interventional signal can be acoustic, magnetic, pressure pulses to name a few examples. While sliding sleeves are an example the application can be a variety of downhole tools that need to move between two positions or more and the movements described are not limited to cyclic opposed movement of a tool component. For example, sequential movements in the same direction are contemplated as are multiple movements in the same direction followed by a reverse movement. The moved component is not limited to axial movement as pivoting or rotational movements are also contemplated.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

The above description is illustrative of the preferred embodiment and many modifications may be made by those skilled in the art without departing from the invention whose scope is to be determined from the literal and equivalent scope of the claims below:

We claim:

1. A treatment apparatus for a subterranean formation accessed by a tubular string, comprising:

a plurality of housings supported by the tubular string with at least one tubular valve member in said housings movable between a closed position to isolate the formation from the string via at least one wall opening in said plurality of housing and an open position to allow access between the tubular string and the formation through said at least one wall opening;

said tubular valve member in said plurality of housing having a through passage formed at least in part by the tubular shape of said tubular valve members that remains open while said valve member responds to discrete non-interventional signals that create pressure induced actuation forces on said valve member to move said valve member more than once between said open and closed positions.

2. The apparatus of claim 1, wherein:

said actuation forces comprise reducing pressure on one side of said valve member.

3. The apparatus of claim 1, wherein:

said actuation forces comprise changing pressure on one side of said valve member.

4. The apparatus of claim 2, wherein:

at least one said non-interventional signal opens a first regulating valve from a first pressurized chamber on one side of said valve member into a lower pressure first reservoir to create a net force on said valve member from a second pressurized chamber on an opposite side of said valve member from said first chamber.

5. The apparatus of claim 4, wherein:

said net force from said second chamber moves said valve member from said closed to said open position.

6. The apparatus of claim 4, wherein:

another said non-interventional signal opens a second regulating valve connecting said second chamber to a lower pressure second reservoir, when said valve member is in said open position, which allows a net force from said first chamber to move said valve member back to said closed position.

7. The apparatus of claim 6, wherein:

a third non-interventional signal opens a third regulating valve to open said first chamber to a lower pressure third reservoir to create a net force on said valve member from said second chamber to regain said open position.

8. The apparatus of claim 6, wherein:

a third non-interventional signal opens a third regulating valve to said second chamber to raise pressure in said second chamber from the tubing string to create a net force on said valve member from said second chamber to regain said open position.

9. The apparatus of claim 7, wherein:

said valve member is locked the second time said open position is attained.

10. The apparatus of claim 8, wherein:

said valve member is locked the second time said open position is attained.

11. The apparatus of claim 2, wherein:

at least one said non-interventional signal opens a first regulating valve from a low pressure chamber on one side of said valve member into a higher pressure first reservoir to create a net force on said valve member move from said closed to said open position.

12. The apparatus of claim 11, wherein:

another said non-interventional signal opens a second regulating valve connecting a second low pressure chamber to a higher pressure second reservoir, when said valve member is in said open position, which allows a net force from said second chamber to move said valve member back to said closed position.

13. The apparatus of claim 12, wherein:

a third non-interventional signal opens a third regulating valve to open said first chamber to a higher pressure third reservoir to create a net force on said valve member from said first chamber to regain said open position.

14. The apparatus of claim 12, wherein:

a third non-interventional signal opens a third regulating valve to said first chamber to raise pressure in said first chamber with pressure from the tubing string to create a net force on said valve member from said first chamber to regain said open position.

15. The apparatus of claim 13, wherein:

said valve member is locked the second time said open position is attained.

16. The apparatus of claim 14, wherein:

said valve member is locked the second time said open position is attained.

17. A treatment method for multiple tools at a subterranean location, comprising:

selectively actuating an operating component on a plurality of tools on a tubing string with discrete non-interventional signals while leaving a passage through said tubing string open;

creating a pressure imbalance on said operating components on said plurality of tools as a result of said signals to selectively move said operating components between at least two positions more than once;

performing the treatment with said operating components being in one of said two positions.

18. The method of claim 17, comprising:

providing variable volume chambers on opposed sides of said operating components; changing pressure in one of said opposed chambers to move a respective said operating component.

19. The method of claim 17, comprising:

making said operating components sliding sleeves and said tools ported subs;

moving a first said sliding sleeve to open a respective ported sub for performing a treatment therethrough followed by closing the same sleeve and then opening a second sleeve to repeat the treatment.

20. The method of claim 19, comprising:

reopening said first sliding sleeve after closing said first sliding sleeve and producing a formation through a respective ported sub.

21. The method of claim 20, comprising:

locking said first sliding sleeve after said reopening;

performing fracturing or acidizing through a respective ported sub after moving said first sliding sleeve to open said ported sub initially.

22. The method of claim 18, comprising:

sequentially moving said operating components between two positions using valves remotely actuated with discrete signals.

23. The method of claim 20, comprising:

performing fracturing or acidizing through a respective ported sub after moving said first sliding sleeve to open said ported sub initially;

closing and locking said sliding sleeve after opening said ported sub.

24. The method of claim 18, comprising:

providing multiple variable volume chambers on opposed sides of said operating components to enable additional cycling of said operating components.

* * * * *